US005416314A

United States Patent [19]

Lopez-Calleja Lopez

[11] Patent Number: 5,416,314

[45] Date of Patent: May 16, 1995

[54] CATHODIC PROTECTION SYSTEM BY PRINTED CURRENT FOR METAL PARTS OF SHIPS HAVING DUAL VOLTAGE REGULATING MEANS

[75] Inventor: Jose L. Lopez-Calleja Lopez, Majadahonda, Spain

[73] Assignees: W.W.I. Proytec, S.L.; Wilson Walton International, S.A.E., both of Madrid, Spain

[21] Appl. No.: 59,166

[22] Filed: May 6, 1993

[30] Foreign Application Priority Data

May 7, 1992 [ES] Spain ..... 9200955

[51] Int. Cl.[6] ..... H01J 40/14

[52] U.S. Cl. ..... 250/214 SG; 204/196

[58] Field of Search ..... 250/214 SG, 214.1, 216; 204/196, 197; 114/39.1, 95; 440/6, 76, 78, 75

[56] References Cited

U.S. PATENT DOCUMENTS

| | | | |
|---|---|---|---|
| 4,136,309 | 1/1979 | Galberth et al. | 204/196 |
| 4,713,158 | 12/1987 | Lambert | 204/196 |
| 5,026,468 | 6/1991 | Carpenter et al. | 204/196 |
| 5,131,341 | 7/1992 | Newman | 114/39.1 |

*Primary Examiner*—David C. Nelms

*Assistant Examiner*—Que T. Le

*Attorney, Agent, or Firm*—Darby & Darby

[57] ABSTRACT

The system is foreseen to cathodically protect the submerged metal structure of ships by using the printed current technique, that is to say, applying a negative potential to the steel structure until placing it at a potential of −800 mv. A photovoltaic cell (1) connected to the battery (3) of the ship (Z) with the insertion of a charge regulator (5) is used as an energy source, the system including an automatic current regulator (6) applicable to the respective anode (7.) The negative output (4') of said regulator is connected to the metal parts such as the propeller (8), and rudder (9), while the positive output (4") or cable is connected to the anode itself (7), the latter consisting of an airproof box in which the cable itself (4") connects to the titanium band that comprises the anode itself, by means of a Faston type terminal, complemented with double insulation, a thermoretractile sleeve and some end covers that ensure the total sealing of the connection. The automatic regulator (6) provides a voltage of 2 volts at the output and an increase of amperage, regarding the input, in order to attain the correct cathodic protection of the metal parts to which the system is applied.

5 Claims, 2 Drawing Sheets

CATHODIC PROTECTION SYSTEM BY PRINTED CURRENT FOR METAL PARTS OF SHIPS HAVING DUAL VOLTAGE REGULATING MEANS

OBJECT OF THE INVENTION

As is expressed in the title of this specification, the present invention refers to a cathodic protection system by printed current, whose purpose is to protect certain submerged metal parts (propeller, propeller shaft, metal supports of the shaft, gliding flaps, rudder if it is made out of metal and the steel reinforcements of the hull in the case of cement ships), protecting in steel or aluminum ones all the underwater hull of the ship. The cathodic protection by printed circuit obtains energy by a photovoltaic cell, thus maintenance will be practically nonexistent, while the entire system will be very small and very inexpensive.

BACKGROUND OF THE INVENTION

In order to cathodically protect steel it is necessary to place it in a negative potential, at least of −800 mv, said protential having to refer to a reference silver-silver chloride electrode.

Cathodic protection can be carried out according to two well defined techniques, one called sacrifice anode and the other by printed current.

When cathodic protection is carried out with a sacrifice anode, the same is based on connecting the steel to be protected to some metals more negative than it, in such a way that with an adequate amount of said metals the desired potential of −800 mv will be achieved.

For said purpose three types of anodes can be used: magnesium anodes (−1,600 mv), aluminum anodes (−1,150 mv) and zinc anodes (−1,050 mv.) These anodes wear down or are sacrificed to protect steel which in this case is cathode, hence the name of sacrifice anode.

Aluminum anodes have in the last few years been used more and more due to their long life and high electro-chemical capacity, although whether they are made out of this material or whether they are made out of the previously cited materials, sacrifice anodes normally have two inconveniences which should be taken into account:

Current output: upon the difference of potential between a sacrifice anode and the steel to be protected fixed, the current output of a specific anode will depend on the electrical resistance of the circuit and thus mainly on the resistivity of the electrolyte (sea water or other water which the ship sails in.) Therefore, a ship that sails in water with a variable resistivity (sea, rivers, etc.) the sacrifice anodes will give a variable current, whereby the cathodic protection will only be effective in waters for which they were designed. The ship may remain without cathodic protection due to the lack of current or on the contrary an excessive production of current with very exaggerated wear of the anodes and a shorter duration thereof.

Anode duration: they wear down and thus a useful life that tends to be the time that passes from the installment up to 85% consumption (utilization factor) in which the anode wears down and has to be replaced by another one, which requires biannual, annual replacement, etc., depending on the size of the anode itself.

When cathodic protection is done by means of printed current, the system is based on applying a negative potential to the steel structure to be protected (cathod) until placing it at a potential of −800 mv, thus an outside electric source is needed and once it is corrected it will be applied in such a way that the negative pole is connected to the steel and the positive pole to the electrolyte (water) by means of some inert electrodes without hardly any wear which, in this case, will be called inert anodes. These anodes have been used being made out of corrosion resistant materials, such as titanium coated with a layer of ruthenium.

The printed current has had an advancement that has been marked by the development of automatic or manual rectifiers, reference electrodes to control potential and above all the important technological development of the latest inert anodes comprised of titanium, development due to electrolysis processes within the large worldwide chemical undertaking. In this sense W.W.I. developed years ago the so-called AQUAMATIC" equipment based on high power platinum-plated titanium anodes (50 or more amperes per anode), automatic rectifiers and zinc reference electrodes that keep the control system of the rectifier informed at all times of the potential of the ship to be protected and gives the necessary orders so that with or less current coming out of the anodes the electric potential of the anode is kept between −800 and −1.500 volts. This equipment that operates correctly in thousands of large ships has the property of automatically adjusting itself to the different water which the ship sails in, even at a variable speed of the ship, in order to keep the potential of the underwater hull of said ship within the established limits. Hence, such equipment is costly or needs maintenance by technicians and a permanent electric energy source.

On the other hand, it must be taken into account that in present-day systems, the potential of the cathode (hull of the ship) is kept between −800 and −1.500 mv, a thing that is obtained by means of a reference electrode that reads the potentials and gives the orders to the automatic regulator so that more or less current is drawn and thus the potentials are kept within the programmed limits. If such an automatism does not exist, they would either remain below −800 mv., whereby the hull would rust, or they could exceed −2,000 mv., whereby the hull would be overprotected and the paint of the ship could peel due to the liberation of hydrogen in the cathode.

It also has to be kept in mind that in conventional cathodic protection systems, the anode-cable connection is done by means of a steel box, said box being welded to the hull of the ship in the inside, while the titanium anode sticks out into the sea through a rather large hole, in such a way that said system involves control and maintenance from inside the ship. The operating responsibility of the system in question, has a second steel seal inside the hull, since if this were not the case there could be the risk that failure of the system could cause sea water to enter with the subsequent danger of buoyancy of the ship, thus this system is costly and requires periodic checks and maintenance.

DESCRIPTION OF THE INVENTION

The cathodic protection system by printed current object of the invention has a series of novel, structural as well as usage, characteristics that lead to low cost equipment on the whole or system, minium maintenance and total elimination of permanent current generators.

In this sense, the cathodic protection system uses a very reliable and high yield monocrystalline photovoltaic cell as an energy source, constituting a model designed for installation thereof on the deck of the corresponding ship, having a transparent front, a rear part comprised of fiberglass and some holes for screws and rubber joint. The cell can be mounted anywhere, with the subsequent space saving as an exclusive site is not required.

The electric energy that this photovoltaic cell provides is accumulated in the battery of the ship, thus, the two components are connected together with the insertion of a battery charge regulatory. There is a second regulator by means of which it is achieved that the most part of the electric energy produced by the photovoltaic cell is used for cathodic protection of the underwater hull of the ship and the rest serves to maintain the battery charged one hundred percent, counteracting the self-discharge of said battery.

It need not even be said that the cell will be a 12 volt one, being able to provide 5, 10, 35 and 50 watts, according to the modules, in such a way that the 5 and 10 watt ones will be connected directly to the battery and the 35 and 50 watt ones will have to have the cited second regulator inserted in between in order to attain correct operation of the system, regulator that will have in all cases a 12 volt input and a 2 volt output, increasing the output amperage with regard to the input amperage.

Said regulator is comprised of a box sealed with resin, with solid state components and a green LED that lights up when when it is connected to the battery.

On the basis of the cited regulator, the 2 volt output is applied to the anode, providing a constant current programmed independently from the electrolyte and from the ship's spped, whereby there will always be cathodic protection. At the same time, upon limiting the voltage to 2 volts, overprotection will be avoided, thus the reference electrode is eliminated and the regulator that has attached conventional systems, radically simplifying the operation and reducing the cost, at the same time that total reliability is achieved without needing maintenance.

Likewise, limitation of the voltage to 2 volts in the anode, turns out to be fundamental, since a considerable energy saving that is necessary given the limitations of the photovoltaic cell is attained. This savings consists of conversion of the 12 volt continous current into alternating current and converting it to 4 volts by means of a transformer, in order to be rectified and then pass to the constant current regulator, which entails that the current consumption in the regulator input is lower than the output thereof towards the anode. In order to achieve that said anode can operate at a maximum of 2 volts, it is necessary to increase the active surface of the anode itself, something that is possible at a low cost with the system of design of the anode that will be described hereinafter.

Therefore, the cathodic protection that is achieved by means of the system of the invention becomes possible without a reference electrode that governs the current of the anode, on the basis of the constant current regulator that electronically proportions the current to an automatically established value, independently from the ship, speed thereof, water, etc. The 2 volt design limit prevents overprotection and the design current indicates the maximum metal surface that can be protected with each type of system. With four types of protection systems, most ships existing on the market, in other words, the world-wide fleet of yachts, can be covered. They can be classified by sizes, into four large groups in accordance with the number of square meters of bare metal or number of times the same metal area has been painted.

As to the anode used in the system, the same will be of titanium and is comprised of a titanium-ruthenium oxide and others band, which are connected to a positive potential cable with a double coating exclusively prepared to be submerged indefinitely in sea water, effecting the cable-anode connection by means of special high pressure Faston terminals, totally sealed by means of thermoretractile sleeves first of all and then to the connection already sealed a second sealing is done upon remaining totally submerged in a hollow U-shaped fiberglass box, which is filled with top quality insulating resin, being completed with a third sealing consisting of two special rubber plugs that adjust to and stick perfectly in the ends of the cited U-shaped fiberglass tube or section, in such a way that all the connections have been attained in a minium space and cost, which has nothing to do with the connection systems of anodes in cathodic protection systems by printed current of ships existing at this time.

The base-anode-cable unit is totally sealed without any type of maintenance, given that same is low cost and also disposable, there being no risk at all for the ship, and only requiring a hole with cable carrier above the floating line, without any risk for the buoyancy of said ship. There must be a conventional electric connection of the anode cable to the positive pole of the anode regulator.

Therefore, the system of the invention makes it possible to carry out cathodic protection that automatically adjusts to the diverse water conditions, not requiring an outside energy source given that it has a photovoltaic cell designed to be placed on deck, resistent to being occasionally stepped on and being capable of covering 100% the energy consumed by the anode, an excess fraction remaining to keep the battery charged 100%, compensating the self-discharge itself thereof when the ship remains in the water for a long time without starting up the engines.

Neither does the system require any type of maintenance, managing to keep the submerged metal elements, such as the propeller, propeller shaft, metal supports of the shaft, rudder if it is made out of metal and gliding flaps, protected. Besides, in cement ships the steel reinforcements of the hull are protected and in steel or aluminum ones the underwater hull of the ship is protected.

It is also necessary to emphasize the fact, according to what has been said above, that applying 2 volts to the anode permits the inclusion of a DC—DC converter that lowers the voltage of 12 volts to one slightly higher of 2 volts to the constant current regulator, thus attaining a savings of the costly photovoltaic energy, higher than 200%.

Finally it should be said that as the unit comprising the sysem is outside the hull of the ship, costs are lowered, eliminating a risk of water entering the ship itself and attaining a top reliable system without maintenance.

In order to complement the description that is made hereinafter and for the purpose of providing a better understanding of the features of the invention, the present specification is accompanied by a set of diagrams on the basis of whose drawings the innovations and advantages of the cathodic protection system object of the invention will be more easily understood.

DESCRIPTION OF A PREFERRED EMBODIMENT

Figure 1:
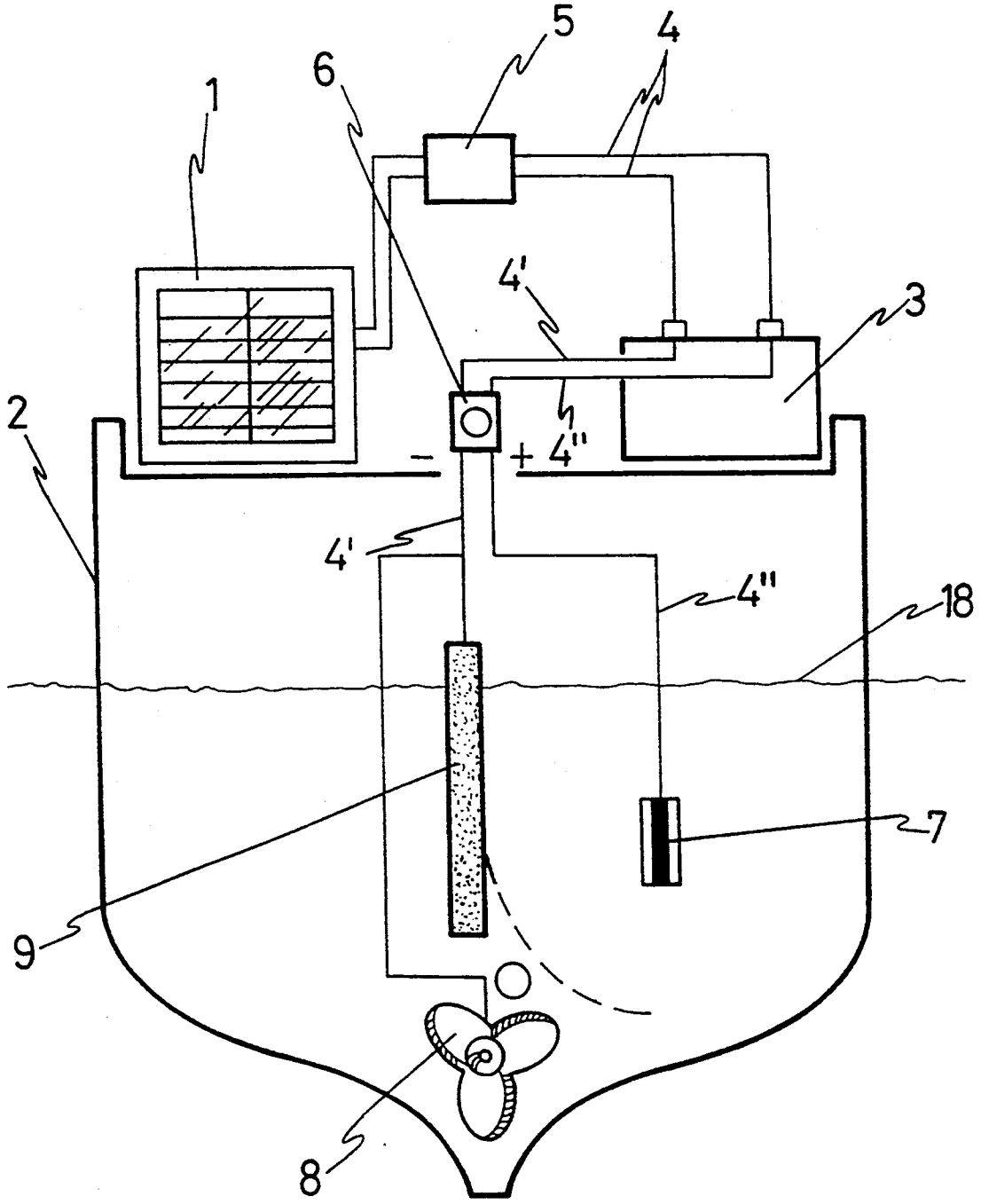
FIG. 1. It shows a schematic view of the system itself of the ship applied to a ship, representing the latter schematically as far as the transversal contour of the hull thereof is concerned.
Figure 2:
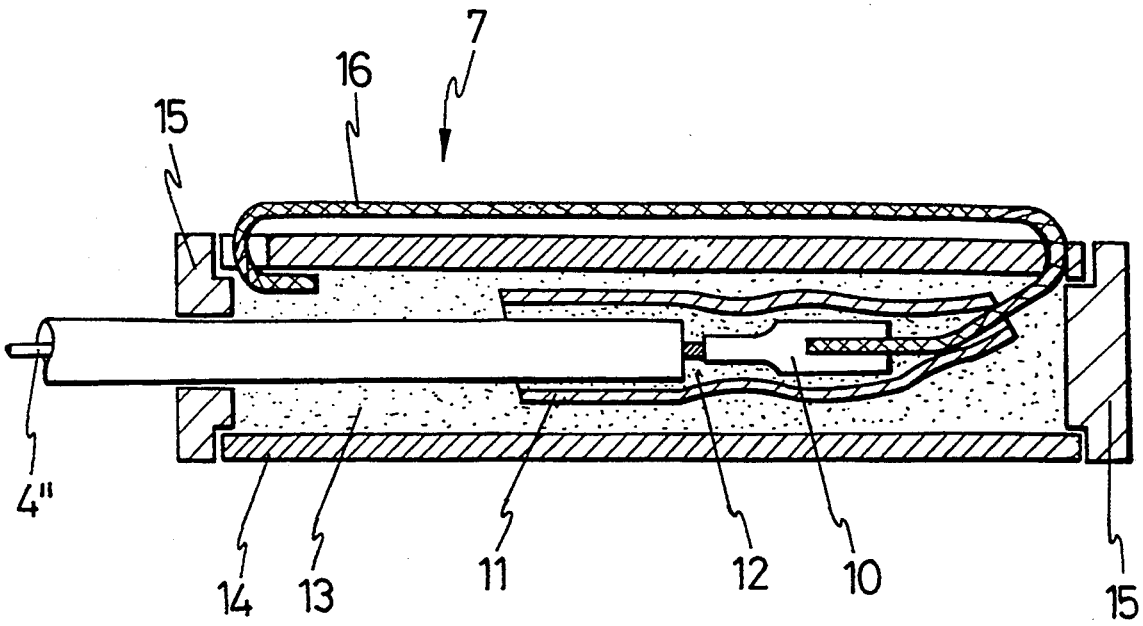
FIG. 2. It shows a longitudinal section view of the anode unit used in the cathodic protection system object of the invention.
Figure 3:
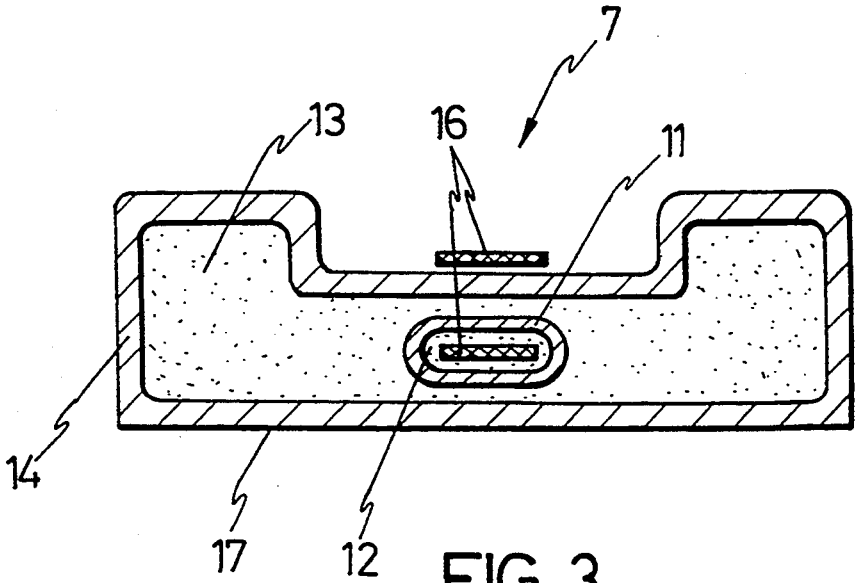
FIG. 3. It shows a cross section of the same anode unit represented in the previous figure.

In view of the figures commented on, one can see how the system of the invention comprises in the first place a waterproof, monocrystalline photovoltaic cell (1) apt to be stepped on, which will be placed anywhere on the deck corresponding to the ship(2.) The energy produced by said photovoltaic cell (1) is accumulated in the battery (3) of the ship itself, the terminals of such a battery (3) being duly connected to the photovoltaic cell itself (1) through the corresponding feed cables (4), with the insertion of a battery charge regulator (5.)

Cables (4') and (4'') that project out from the battery are connected to an automatic regulator (6) of the anode (7), in such a way that the negative output (4') of the latter branch off into two cables connected independently to the propeller (8) of the ship and to the rudder (9), respectively, of the ship; while the positive output (4'') connects to the above cited anode (7.) Logically, the connections are adequately insulated in such a way that top quality thermoretractile insulation will be used inside the ship, in areas where there is no water, while the negative cable (4') with its shunt connections will be connected to all the terminals that are going to be cathodically protected, doing the connection with metals with cable having a 2.5 square meter section and terminals tinned to the cable itself and by screws, nuts, washers, all made out of stainless steel, lubricated with molybdenum disulfide grease, effecting the connection within the ship and outside the water, to the: engine, transmission, rudder and flaps.

The connection of the positive cable (4'') to the anode is done by means of a Faston terminal with a special pressure, that is going to be tinned to the cited cable (4''.) In order to ensure the sealing of the connection there are four seals, formed by a retractile sleeve (11), an inside resin mass (12) that melts due to the temperature, an outside resin mass (13) inside the U-shaped section (14) that forms the fiberglass box and two rubber plugs (15) adjusted and stuck to the ends of said box (14.)

The anode consists of a titanium band (16) as has been referred to before, the unit being stuck to the hull of the ship by the bottom surface (17) of the fiberglass box or section itself (14), it being foreseen that the two surfaces of the ship and anode are smoothed off and stuck with polyester in such a way that the cable (4'') will pass through the hull above the floating line (18), through a rubber cable carrier adjusted and stuck with rubber glue to the hull itself and to the cable, in order to prevent water from entering.

Hereinafter there is a comparative table between the cathodic protection systems presently used today and the system object of the invention, from whose table one can clearly see the advantages and services that the cathodic protection achieved by means of the system of the invention offers with regard to that achieved by traditional systems.

COMPARATIVE TABLE OF PRESENT CATHODIC PROTECTION SYSTEMS AND THE ONE OF THE INVENTION

| | SACRIFICE ANODE | PRINTED CURRENT | INVENTION |
|---|---|---|---|
| CATHODIC PROTECTION POTENTIAL | −800 MV | −800 MV | −800 MV |
| SYSTEM LIFE | 1 YEAR YACHTS | 15-20 YEARS | 15-20 YEARS |
| ENERGY SOURCE NEED | NO | SHIP'S GENERATORS | NO |
| OVERPROTECTION RISK | NO | YES | NO |
| NEED FOR MAINTENANCE | NO | YES | NO |
| ADJUSTMENT | NO | YES | NO |
| USEFULNESS | CATHODIC PROTECTION | CATHODIC PROTECTION | CATHOD. PROT. BATTERY CHAR. |
| ADAPTABILITY TO WATER CHANGE | NO | YES | YES |
| ADAPTABILITY TO SHIP'S SPEED | NO | YES | YES |
| APPLICABLE TO YACHTS | YES | NO | NO |

What is claimed:

1. A cathodic protection system for protecting metal parts of a ship comprising:

a photovoltaic cell;

a battery having an output voltage;

a first regulating means connected between the photovoltaic cell and said battery for regulating the charge from the photovoltaic cell to the battery;

a second regulating means connected to the battery for regulating the output voltage from the battery to a constant predetermined voltage, the second regulating means having a negative output terminal and a positive output terminal, the negative output terminal being connected to at least some of the metal parts of the ship; and an anode connected to the positive terminal of the second regulating means.

2. The system of claim 1 wherein the constant predetermined voltage is 2 volts.

3. The system of claim 2 wherein the anode is connected to the positive terminal by a connecting terminal attached to a cable leading to the positive terminal, the anode comprising:

a U-shaped housing, the housing closed at its ends by rubber plugs, the connecting terminal being positioned within the housing;

an activated titanium band connected to the connecting terminal, the titanium band having a portion extending outside the housing;

a sleeve surrounding the connecting terminal and a portion of the titanium band near the connecting terminal;

an first resin mass positioned within the sleeve; and a second resin mass filling the housing but outside the retractable sleeve.

4. The system of claim 3 wherein the connecting terminal is a Faston terminal.

5. The system of claim 3 wherein the sleeve is retractable.

* * * * *